US010399337B2

(12) United States Patent
Kato

(10) Patent No.: US 10,399,337 B2
(45) Date of Patent: Sep. 3, 2019

(54) LIQUID JETTING DEVICE WITH PROJECTIONS DISPOSED IN A COMMON LIQUID CHAMBER

(71) Applicant: BROTHER KOGYO KABUSHIKI KAISHA, Nagoya-shi, Aichi-ken (JP)

(72) Inventor: Yasuo Kato, Aichi-ken (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/881,869

(22) Filed: Jan. 29, 2018

(65) Prior Publication Data

US 2018/0264814 A1 Sep. 20, 2018

(30) Foreign Application Priority Data

Mar. 17, 2017 (JP) ..... 2017-053262

(51) Int. Cl.
*B41J 2/14* (2006.01)

(52) U.S. Cl.
CPC ..... *B41J 2/1433* (2013.01); *B41J 2/14233* (2013.01); *B41J 2002/14241* (2013.01); *B41J 2002/14403* (2013.01); *B41J 2002/14419* (2013.01); *B41J 2002/14491* (2013.01)

(58) Field of Classification Search
CPC ..... B41J 2/1433; B41J 2/14233
See application file for complete search history.

(56) References Cited

U.S. PATENT DOCUMENTS

2012/0113197 A1* 5/2012 Kashu ..... B41J 2/1404 347/89
2014/0028759 A1* 1/2014 Ozawa ..... B41J 2/14 347/68
2015/0028125 A1* 1/2015 Fukuda ..... B41J 2/14201 239/102.2
2015/0314601 A1* 11/2015 Rivas ..... B41J 2/1404 347/22

FOREIGN PATENT DOCUMENTS

JP 2014-034138 A 2/2014

* cited by examiner

*Primary Examiner* — Bradley W Thies
(74) *Attorney, Agent, or Firm* — Scully, Scott, Murphy & Presser, P.C.

(57) ABSTRACT

A liquid jetting device includes a common liquid chamber having a first surface and a second surface opposite to the first surface and including an upstream portion and a downstream portion, a plurality of outflow holes are arranged along a direction, and a plurality of projections disposed between the first surface and the second surface transverse to the direction and disposed between the upstream portion and the downstream portion. The plurality of the projections define a plurality of the fluid flow paths therebetween from the upstream portion to the downstream portion. The fluid flow paths rejoin at the downstream portion. The plurality of projections are arranged along the direction. The plurality of projections are on an opposite side of a plane orthogonal to the second direction and extending through the outflow holes.

23 Claims, 14 Drawing Sheets

LIQUID JETTING DEVICE WITH PROJECTIONS DISPOSED IN A COMMON LIQUID CHAMBER

CROSS-REFERENCE TO RELATED APPLICATION

This application claims priority from Japanese Patent Application No. 2017-053262 filed on Mar. 17, 2017, the content of which is incorporated herein by reference in its entirety.

FIELD OF DISCLOSURE

The present disclosure relates to a liquid jetting device that jets a liquid such as an ink.

BACKGROUND

A liquid jetting device is a type of a device that jets a liquid such as an ink to an object such as paper. A liquid jetting device is included in, for example, a recording head in an inkjet printer. Japanese Unexamined Patent Application Publication No. 2014-34138 discloses an example of a conventional liquid jetting device. The conventional liquid jetting device has a plurality of nozzles, a plurality of pressure chambers that apply pressure to a liquid so that the liquid is jetted from the nozzles, a reservoir that stores the liquid, and a common liquid chamber that stores the liquid to be supplied to each pressure chamber. The reservoir communicates with the common liquid chamber, the common liquid chamber communicates with the plurality of pressure chambers, and the plurality of pressure chambers communicate with the plurality of nozzles in one-to-one correspondence. The liquid is supplied from the reservoir to the common liquid chamber and then supplied from the common liquid chamber to each pressure chamber. Each pressure chamber stores a liquid and applies pressure to the liquid by a pressure generating means such as a piezoelectric film to jet the liquid from the nozzle. The common liquid chamber has a supply hole through which a liquid is supplied, and also has a plurality of outflow holes through which the liquid flows out. The liquid is supplied from the reservoir through the supply hole to the common liquid chamber, after which the liquid is supplied from the common liquid chamber through the flow-out holes to the pressure chambers.

SUMMARY

When the liquid is jetted from all nozzles, the entire amount of liquid in the common liquid chamber is reduced, so a sufficient amount of liquid may not be supplied to the nozzles. If a sufficient amount of liquid is not supplied, each pressure chamber cannot cause a necessary amount of liquid to be jetted from the nozzle.

The common liquid chamber has been conventionally formed by etching a semiconductor substrate. Due to the etching, concave parts and convex parts are formed on the inner surfaces of the common liquid chamber. When a member in which the common liquid chamber is formed is pressurized during the assembling of the liquid jetting device, the member is likely to be cracked due to the concave parts and convex parts formed on the inner surfaces of the common liquid chamber.

The present disclosure addresses the above situation with the object of providing a liquid jetting device that not only can supply a sufficient amount of liquid to pressure chambers and but also can suppress damage.

A liquid jetting device includes a common liquid chamber, a plurality of outflow holes, a plurality of pressure chambers and a plurality of projections. The common liquid chamber is in fluid communication with a reservoir. The common liquid chamber has a first surface and a second surface opposite to the first surface and including an upstream portion and a downstream portion. The plurality of outflow holes are in the first surface. The plurality of outflow holes are arranged along a direction. The plurality of pressure chambers are in fluid communication with the plurality of outflow holes. The plurality of projections disposed between the first surface and the second surface transverse to the direction and disposed between the upstream portion and the downstream portion. The plurality of the projections define a plurality of the fluid flow paths therebetween from the upstream portion to the downstream portion. The fluid flow paths rejoin at the downstream portion. The plurality of projections are arranged along the direction. The outflow holes in the first surface are at the downstream portion of the common liquid chamber and extend from the downstream portion to the pressure chamber through the first surface in a second direction. The plurality of projections are on an opposite side of a plane orthogonal to the second direction and extending through the outflow holes than the pressure chamber.

Therefore, the volume of the common liquid chamber can be increased while the strength of the member is maintained. Since the volume of the common liquid chamber is large, a large amount of liquid is stored in the common liquid chamber, so a sufficient amount of liquid is supplied to all pressure chambers. In addition, since the member in which the common liquid chamber is formed is reinforced by the plurality of projections, damage to the member is suppressed, which would otherwise be caused by concave parts and convex parts formed on the inner surfaces of the common liquid chamber.

In the present invention, a liquid is smoothly supplied to pressure chambers that generate pressure used to jet the liquid. Therefore, the liquid jetting device can smoothly jet a necessary amount of liquid. In addition, damage to a member can be suppressed. Thus, the present invention provides superior effects.

DESCRIPTION OF THE PREFERRED EMBODIMENTS

Embodiments of the disclosure will be specifically described below with reference to the drawings.

First Embodiment

Figure 1:
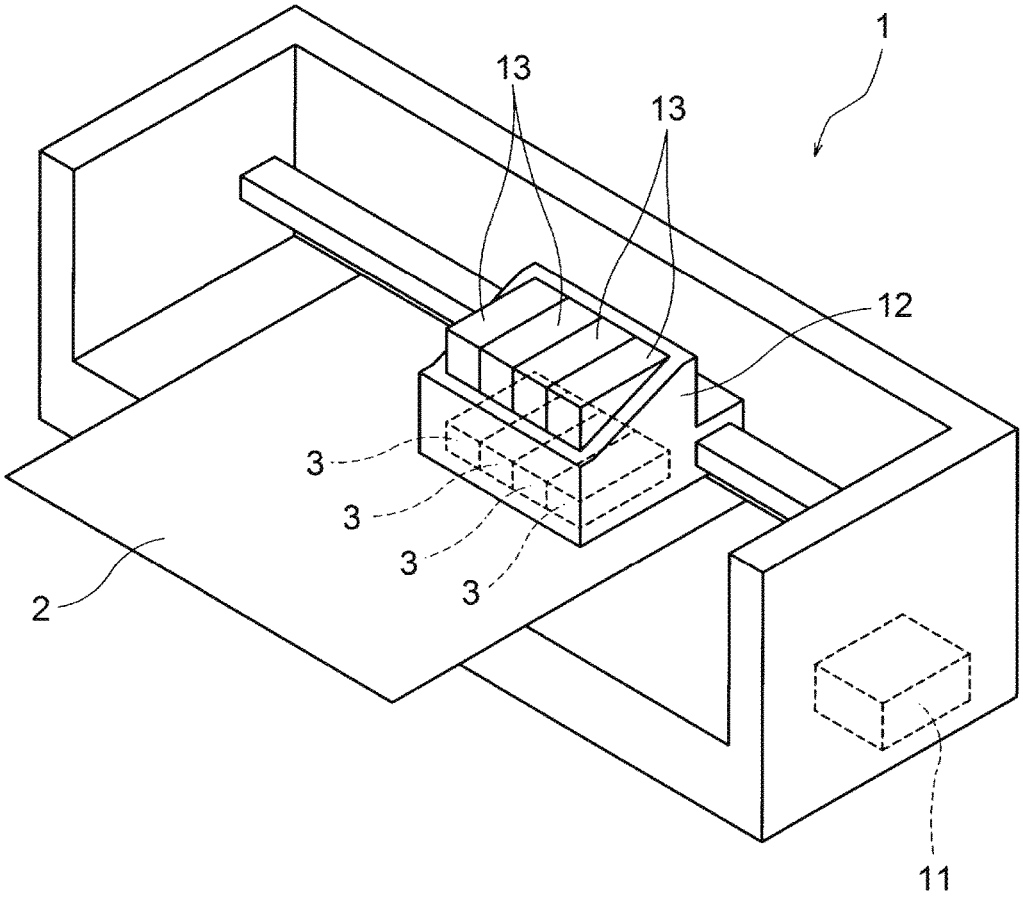
FIG. 1 is a schematic perspective view illustrating an example of an inkjet printer.

An inkjet printer 1 is a type of apparatus that jets ink from a recording head 12 to a recording sheet 2 such as paper to record an image as illustrated, for example, in FIG. 1. In addition to the recording head 12, the inkjet printer 1 has a controller 11 that controls the whole of the inkjet printer 1, a feeding mechanism (not illustrated) that feeds the recording sheet 2, and a moving mechanism (not illustrated) that moves the recording head 12. The controller 11 includes a calculation unit that performs calculations and a memory that stores information needed for calculations. The controller 11 controls the operations of the recording head 12, feeding mechanism, and moving mechanism.

The recording head 12 has a plurality of ink tanks 13 and a plurality of head units 3 (liquid jetting devices). Each head unit 3 is the liquid jetting device in the present invention. The head unit 3 jets ink to the recording sheet 2. An ink corresponds to a liquid in the present invention. The inkjet printer 1 uses inks in a plurality of colors. One ink tank 13 and one head unit 3 are provided for each color. The inkjet printer 1 uses, for example, four colors, which are cyan (C), magenta (M), yellow (Y) and black (K), and the recording head 12 has four ink tanks 13 and four head units 3. The ink tanks 13 and head units 3 are in one-to-one correspondence with each other. Ink is supplied from each ink tank 13 to its corresponding head unit 3.

The head unit 3 is shaped like a substantially rectangular parallelepiped. The head unit 3 is placed so that its one surface faces the front surface of the recording sheet 2. The surface, facing the recording sheet 2, of the head unit 3 will be referred to below as the bottom surface 32. A portion of the head unit 3, the portion being opposite to the bottom surface 32, has an introduction hole through which ink is introduced from the ink tank 13.

A plurality of jetting holes 331 through which ink is jetted are formed in the bottom surface 32 of the head unit 3. In the example in FIG. 2, two rows of jetting holes 331, in each of which a plurality of jetting holes 331 are linearly arranged, are formed substantially in parallel. A direction along which the plurality of jetting holes 331 are arranged in one row will be referred to as a first direction. The first direction is, for example, a direction along which the recording sheet 2 is fed in the inkjet printer 1. A direction that crosses the first direction along the bottom surface 32 will be referred to as a second direction. The second direction is, for example, a direction along which the recording head 12 moves. The jetting holes 331 in the two rows are placed so that the positions of the jetting holes 331 along the first direction do not match between the two rows. Specifically, the jetting holes 331 included in one row are positioned so as to be shifted in the first direction with respect to the jetting holes 331 included in the other row. The number of jetting holes 331 included in one row may differ from the number of jetting holes 331 illustrated in FIG. 2.

Figure 2:
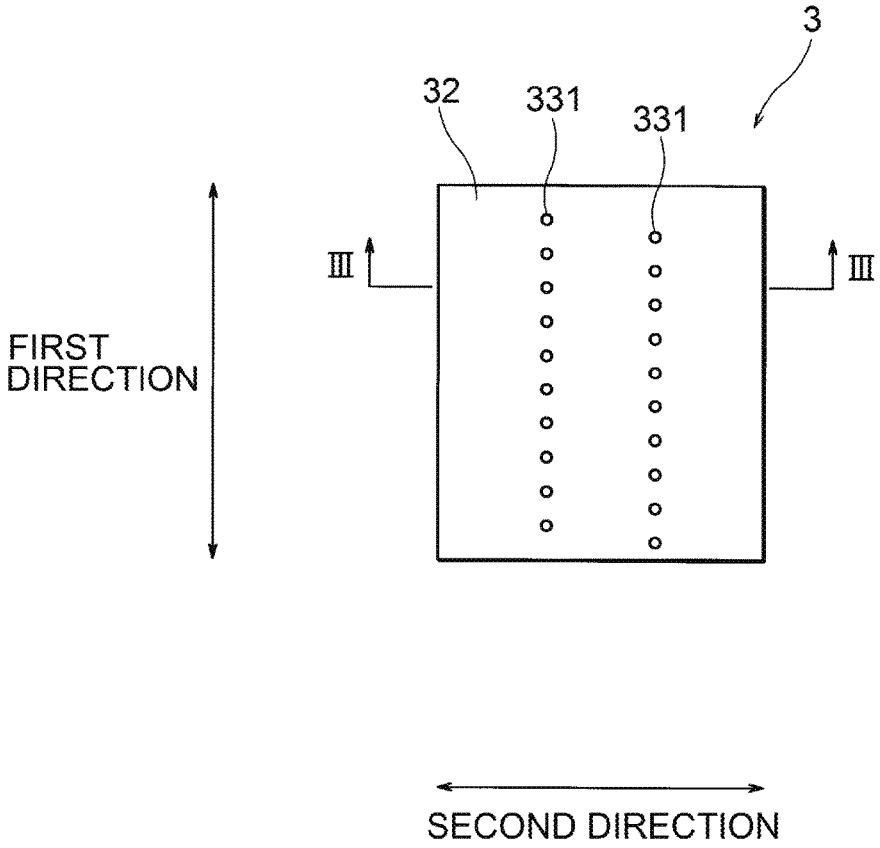
FIG. 2 is a schematic bottom view illustrating an example of the structure of the bottom surface of a head unit.
Figure 3:
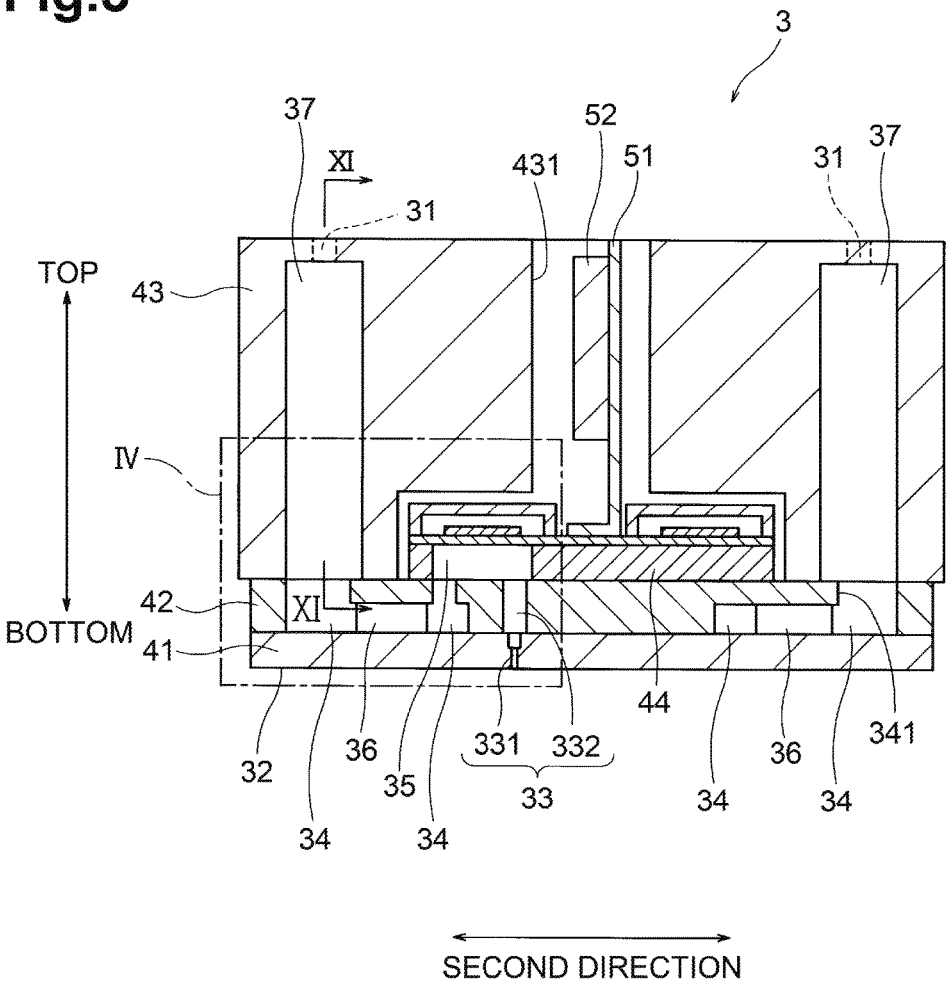
FIG. 3 is a schematic cross-sectional view illustrating the internal structure of the head unit according to a first embodiment.
Figure 4:
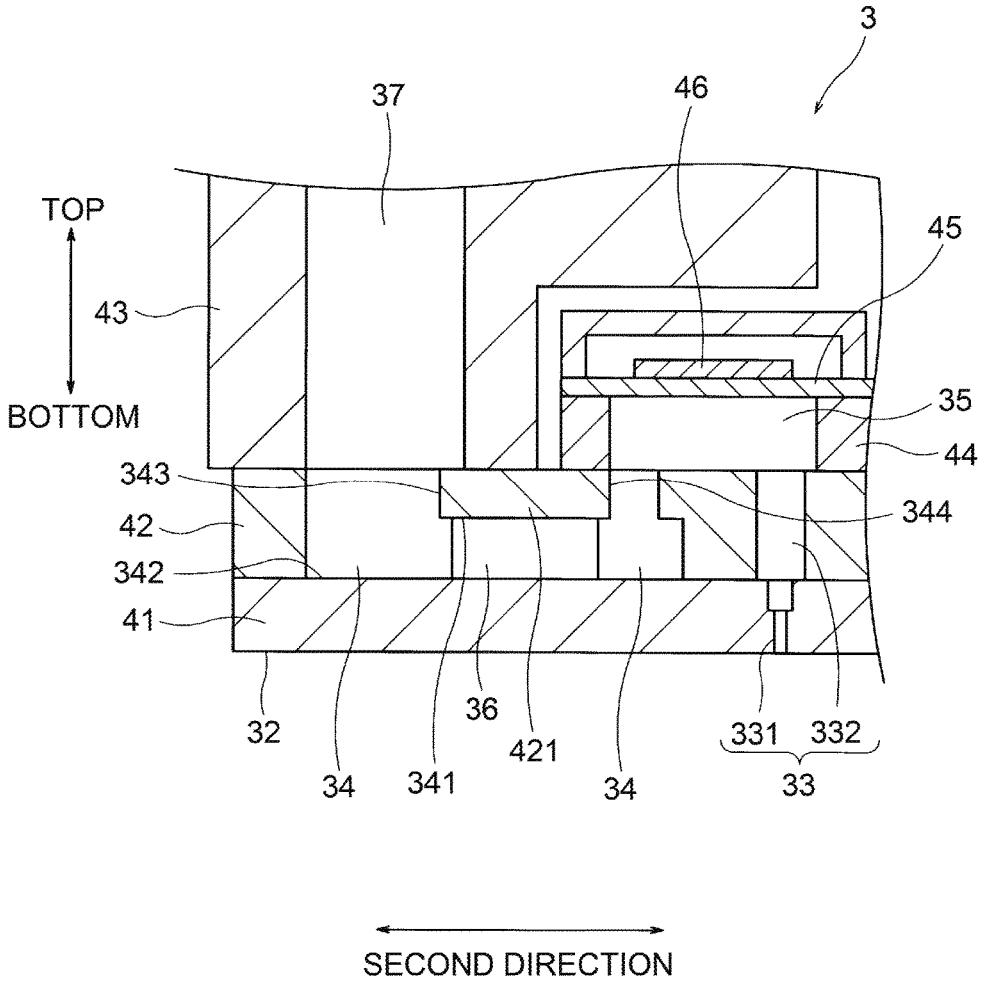
FIG. 4 is an enlarged schematic cross-sectional view illustrating part of the interior of the head unit according to the first embodiment.

FIG. 3 is a cross-sectional view of the head unit 3 as taken along line III-III in FIG. 2. FIG. 4 is an enlarged view illustrating a portion enclosed by lines IV in FIG. 3. For convenience of explanation, a direction orthogonal to the bottom surface 32 of the head unit 3 will be referred to below as the vertical direction, the same side as the bottom surface 32 will be referred to be below as the lower side, and the side opposite to the lower side will be referred to below as the upper side. The second direction crosses the first direction and vertical direction. The head unit 3 is formed by laminating a plurality of members. An ink flow path is formed in the head unit 3. Mechanisms that generate pressure to jet ink are also provided in the head unit 3.

The head unit 3 includes a nozzle plate 41, a flow path substrate 42, a pressure chamber substrate 44, and an ink supply member 43. The nozzle plate 41, flow path substrate 42, and pressure chamber substrate 44 are shaped like a rectangular flat plate. One surface of the nozzle plate 41 is the bottom surface 32 of the head unit 3. The flow path substrate 42 is laminated on the nozzle plate 41, and the pressure chamber substrate 44 is laminated on the flow path substrate 42. The pressure chamber substrate 44 is smaller than the flow path substrate 42 in a plan view. The ink supply member 43 is shaped like a block. The ink supply member 43 has a storage chamber 431. The storage chamber 431 passes through the ink supply member 43 vertically and has a rectangular opening that is elongated along the first direction. The ink supply member 43 is placed on the flow path substrate 42 with the pressure chamber substrate 44 accommodated in the storage chamber 431. As illustrated in FIGS. 3 and 4, the pressure chamber substrate 44 is laminated on part of the flow path substrate 42, and the ink supply member 43 is placed on another part of the flow path substrate 42. The nozzle plate 41 and flow path substrate 42 are mutually bonded, the flow path substrate 42 and pressure chamber substrate 44 are mutually bonded, and the flow path substrate 42 and ink supply member 43 are mutually bonded. A cable 51 and a control circuit 52 are placed in the storage chamber 431. The control circuit 52 is connected to the cable 51.

The nozzle plate 41 is formed from a metal plate or semiconductor substrate. As illustrated in FIG. 2, a plurality of jetting holes 331 are formed in the nozzle plate 41. Each jetting hole 331 passes through the nozzle plate 41 and is open to the bottom surface 32 and upper surface.

The flow path substrate 42 is formed from a semiconductor substrate. A plurality of communication holes 332 communicating with the plurality of jetting holes 331 are formed in the flow path substrate 42. Each communication hole 332 passes through the flow path substrate 42. Each of the plurality of communication holes 332 communicates with one of the plurality of jetting holes 331. A combination of the jetting holes 331 and communication holes 332 forms a nozzle 33.

The pressure chamber substrate 44 is formed from a semiconductor substrate. A plurality of pressure chambers 35 communicating with the plurality of communication holes 332 are formed in the pressure chamber substrate 44. Each pressure chamber 35 is a hollow interior used to store ink and apply pressure the ink so that the ink is jetted from the nozzle 33. The pressure chamber 35 passes through the pressure chamber substrate 44. An elastic film 45 is laminated on the pressure chamber substrate 44. The inner surface of the pressure chamber 35 on the upper side is the lower surface of the elastic film 45. The inner surface of the pressure chamber 35 on the lower side is the upper surface of the flow path substrate 42. Each of the plurality of pressure chambers 35 communicates with one of the plurality of communication holes 332. The pressure chamber 35 is elongated along the second direction. The plurality of pressure chambers 35 are arranged along the first direction in correspondence to the rows of the jetting holes 331.

A common liquid chamber 34 not communicating with the plurality of communication holes 332 is formed in the flow path substrate 42. The common liquid chamber 34 is a common hollow interior that temporarily stores ink to be supplied to the plurality of pressure chambers 35. The plurality of communication holes 332 and the common liquid chamber 34 are formed by etching. A first inner surface 341 of the common liquid chamber 34 is an inner surface on the upper side, and is an etched surface of the flow path substrate 42 formed by half etching. The flow path substrate 42 corresponds to a first member in the present invention. A second inner surface 342 of the common liquid chamber 34 is an inner surface on the lower side, and is the upper surface of the nozzle plate 41. Reinforcing projections 36 (projections), which will be described later, are placed in the common liquid chamber 34. A supply hole 343, through which ink is supplied, and a plurality of outflow holes 344, through which the ink flows out, are open to the first inner surface 341 of the common liquid chamber 34. The plurality of outflow holes 344 are arranged along the first direction. Each of the plurality of outflow holes 344 communicates with one of the plurality of pressure chambers 35. The common liquid chamber 34 communicates with the plurality of pressure chambers 35 through the plurality of outflow holes 344.

The ink supply member 43 is formed from a metal or a resin. The ink supply member 43 corresponds to a second member in the present invention. A reservoir 37, which is a hollow interior used to store ink, is formed in the ink supply member 43. As illustrated in FIG. 3, the reservoir 37 communicates with an introduction hole 31 into which ink is introduced from the ink tank 13. As illustrated in FIG. 4, the reservoir 37 communicates with the supply hole 343. The ink is introduced from the ink tank 13 into the introduction hole 31, after which the ink is supplied to the reservoir 37 through the introduction hole 31. The ink is held in the reservoir 37 and is then supplied to the common liquid chamber 34 through the supply hole 343. The ink is stored in the common liquid chamber 34 and is then supplied into the pressure chambers 35 through the outflow holes 344. Since the flow of ink branches from the common liquid chamber 34 to the plurality of outflow holes 344, the common liquid chamber 34 functions as a manifold.

The elastic film 45 is a film including silicon dioxide ($SiO_2$) or silicon nitride ($SiN_2$). A plurality of piezoelectric elements 46 are provided on the elastic film 45. Each of the plurality of piezoelectric elements 46 is placed at a position corresponding to the upper side of one of the plurality of pressure chambers 35. Each piezoelectric element 46 is connected to the cable 51 through a wire (not illustrated). The control circuit 52 accepts a control signal transmitted from the controller 11 through the cable 51, generates a driving signal used to drive the piezoelectric element 46 in response to the accepted control signal, and outputs the generated signal. The driving signal is, for example, a pulse voltage signal.

The piezoelectric element 46 performs bending driving vertically in response to the driving signal, bending the elastic film 45 vertically. The pressure in the pressure chamber 35 is raised and lowered. When the pressure is raised, ink is pushed out of the interior of the pressure chamber 35 and is jetted to the outside through the nozzle 33. When the pressure is lowered, ink is supplied from the common liquid chamber 34 into the pressure chamber 35.

To smoothly jet ink, it is important for ink to be smoothly supplied into the pressure chamber 35. The larger the volume of the common liquid chamber 34 is, the more ink flows into the common liquid chamber 34, so ink is likely to be smoothly supplied into the pressure chamber 35. The smaller the vertical thickness of a thin part 421, which is placed between the first inner surface 341 and the upper surface of the flow path substrate 42 (first member), is, the larger the volume of the common liquid chamber 34 is. However, the smaller the thickness of the thin part 421 is, the lower the strength of the flow path substrate 42 is, so the flow path substrate 42 is likely to be damaged. In the present invention, therefore, the reinforcing projections 36 are placed in the common liquid chamber 34 to reinforce the flow path substrate 42.

The common liquid chamber 34 is formed by half-etching the flow path substrate 42 from the lower surface. Furthermore, the supply hole 343, outflow holes 344, and communication holes 332 are formed by etching. A plurality of reinforcing projections 36 are placed in the common liquid chamber 34. Each reinforcing projection 36 is a plate-like plate crossing the first direction. The plurality of reinforcing projections 36 are arranged along the first direction at equal intervals. The reinforcing projection 36 corresponds to a projection in the present invention. The reinforcing projection 36 is formed, for example, integrally with the flow path substrate 42 by etching. Alternatively, the reinforcing projection 36 is formed by, for example, bonding a plate-like material to the first inner surface 341 or second inner surface 342.

Figure 5:
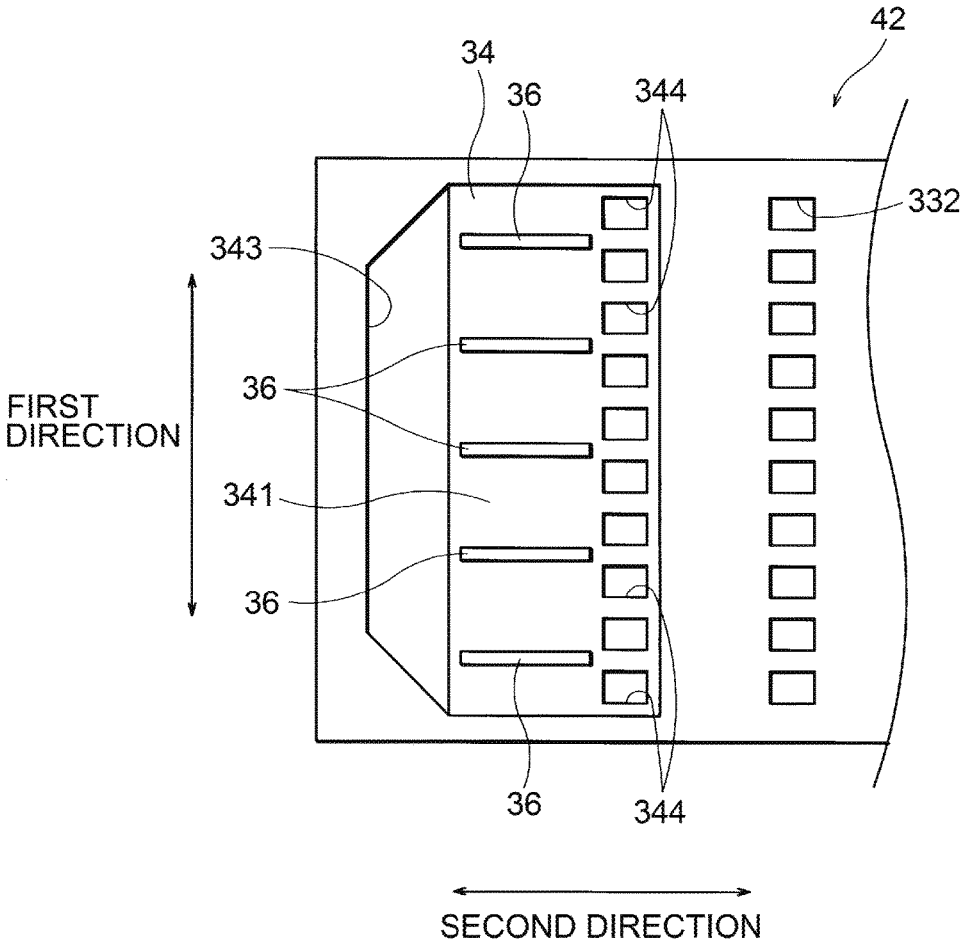
FIG. 5 is a schematic bottom view illustrating the bottom surface of a flow path substrate according to the first embodiment.

In the common liquid chamber 34, the reinforcing projections 36 are placed between the first inner surface 341 and the second inner surface 342, as illustrated in FIGS. 3 and 4. Each reinforcing projection 36 may be in contact with both the first inner surface 341 and the second inner surface 342, or may not be in contact with one of the first inner surface 341 and second inner surface 342. The reinforcing projections 36 are not placed between the supply hole 343 and the second inner surface 342. The reinforcing projections 36 are not also placed between the common liquid chamber 34 and the second inner surface 342. Furthermore, the reinforcing projections 36 are not placed between the second inner surface 342 and portions among the plurality of outflow holes 344 in the first inner surface 341. Therefore, ink not only flows from the supply hole 343 toward the outflow holes 344 but also flows to a portion between each two adjacent outflow holes 344. Therefore, ink is supplied to the outflow holes 344 from both sides in the first direction as well. This enables much more ink to be supplied to the outflow holes 344 when compared with a case in which the reinforcing projection 36 extends up to a portion between the outflow holes 344. Specifically, as illustrated in FIG. 4, each reinforcing projection 36 is placed between the nozzle plate 41 and the thin part 421 of the flow path substrate 42. As illustrated in FIG. 5, the number of reinforcing projections 36 placed in the common liquid chamber 34 is smaller than the number of outflow holes 344. The number of reinforcing projections 36 may differ from the number of reinforcing projections 36 illustrated in FIG. 5.

Since a plurality of reinforcing projections 36 are placed in the common liquid chamber 34, the thin part 421 of the flow path substrate 42 is reinforced. Even if, for example, an eternal force is exerted vertically, the reinforcing projections 36 support the thin part 421, preventing the flow path substrate 42 from being deformed. In this embodiment, therefore, the thickness of the thin part 421 can be reduced while the strength of the flow path substrate 42 is maintained, unlike a case in which the reinforcing projection 36 is not provided. That is, the distance between the first inner surface 341 and the upper surface of the flow path substrate 42 can be reduced and the distance between the first inner surface 341 and the second inner surface 342 can be increased, without having to change the thickness of the flow path substrate 42. When the distance between the first inner surface 341 and the second inner surface 342 is increased, the volume of the common liquid chamber 34 is increased. When the volume of the common liquid chamber 34 is increased, an amount by which the common liquid chamber 34 stores ink is increased. When the amount of ink stored in the common liquid chamber 34 is large, a sufficient amount of ink flows out of all outflow holes 344 and a sufficient amount of ink is supplied to all pressure chambers 35. After, for example, ink has been jetted from all nozzles 33, the total amount of ink in the common liquid chamber 34 may be reduced. Even in this case, the amount of ink that flows out of the outflow holes 344 is less likely to be reduced because the amount of ink originally stored in the common liquid chamber 34 is large. Accordingly, a sufficient amount of ink is still supplied to the pressure chamber 35. In this embodiment, therefore, ink is smoothly supplied into the pressure chamber 35, and a necessary amount of liquid is smoothly jetted from each nozzle 33.

Since the first inner surface 341 has been formed by half-etching the flow path substrate 42, the first inner surface 341 has small concave parts and convex parts. Due to these concave parts and convex parts on the first inner surface 341, the strength of the flow path substrate 42 is lowered, so the flow path substrate 42 is likely to be cracked. In this embodiment, however, the reinforcing projections 36 reinforce the flow path substrate 42, damage to the flow path substrate 42 due to the concave parts and convex parts formed on the first inner surface 341 is less likely to occur when compared with a case in which the reinforcing projection 36 is not provided. Even if, for example, the thin part 421 of the flow path substrate 42 is pressurized by the ink supply member 43 during the assembling of the head unit 3, damage to the flow path substrate 42 is suppressed.

Since the number of reinforcing projections 36 is smaller than the number of outflow holes 344, resistance caused by a contact of ink with the reinforcing projections 36 is less increased. Therefore, the flow of ink in the common liquid chamber 34 is smoothly maintained. The reinforcing projections 36 are placed neither between the outflow hole 344 and the second inner surface 342 nor between the second inner surface 342 and portions among the plurality of outflow holes 344 in the first inner surface 341. Therefore, since, for example, remaining ink resulting from too much ink to flow out of one outflow hole 344 flows into another outflow hole 344, ink flows among the plurality of outflow holes 344 without being impeded by the reinforcing projections 36. Accordingly, ink smoothly flows out of the plurality of outflow holes 344 and is smoothly supplied to the plurality of pressure chambers 35. The head unit 3 can smoothly jet a necessary amount of ink from each nozzle 33.

Second Embodiment

Figure 6:
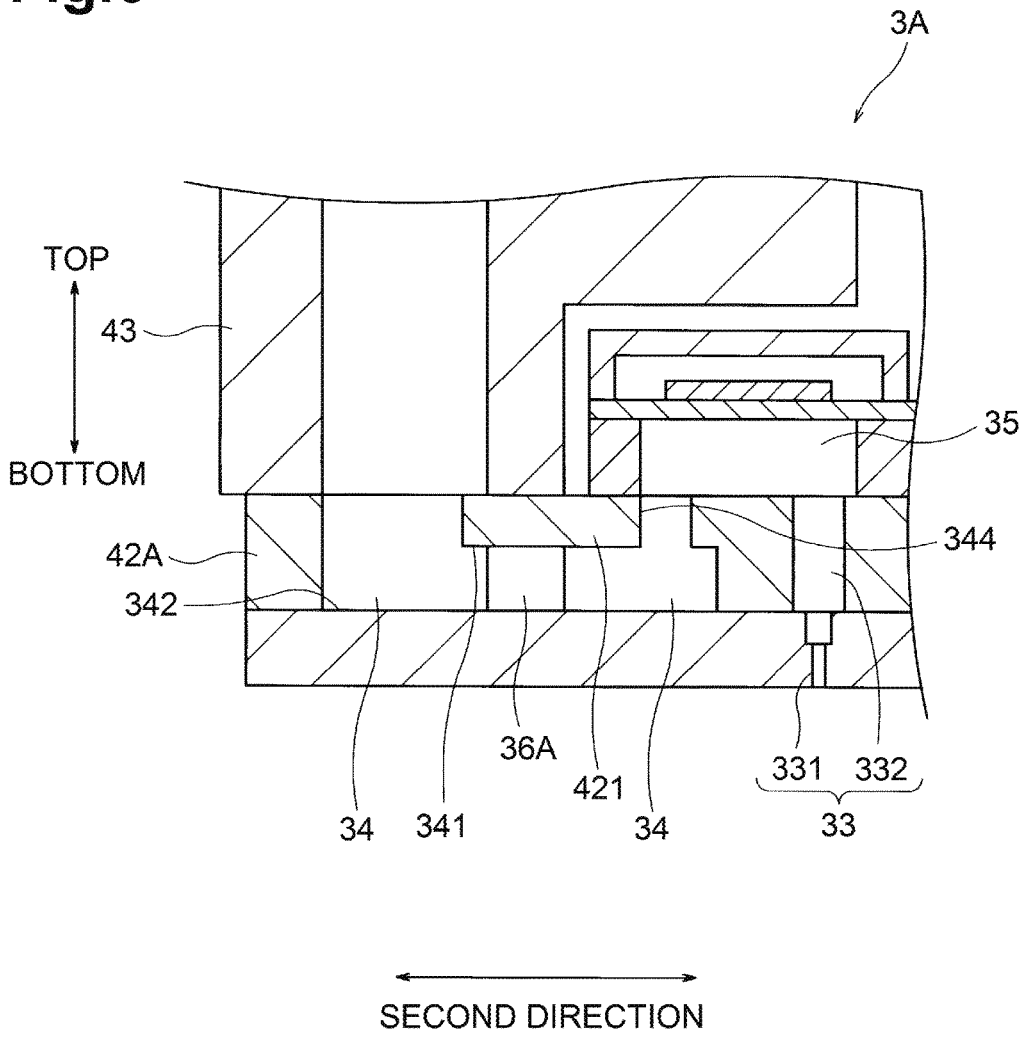
FIG. 6 is an enlarged schematic cross-sectional view illustrating part of the interior of a head unit according to a second embodiment.

In a head unit 3A according to a second embodiment as illustrated, for example, in FIG. 6, a plurality of reinforcing projections 36A are placed only in an area that vertically overlaps a portion where the upper surface of a flow path substrate 42A and the ink supply member 43 (second member) are in contact with each other. The upper surface of the thin part 421 of the flow path substrate 42A includes a portion with which the ink supply member 43 is in contact. The first inner surface 341 of the common liquid chamber 34 includes a portion positioned on the rear side of the upper surface of the thin part 421. Therefore, the first inner surface 341 includes a rear-side portion positioned on the rear side with respect to a portion, on the outer surface of the flow path substrate 42A, with which the ink supply member 43 is in contact. The reinforcing projections 36A are placed only between the second inner surface 342 and the rear-side portion included in the first inner surface 341. In this embodiment, the reinforcing projections 36A are not placed in any other portions. The structures of other parts of the head unit 3A are the same as in the first embodiment.

When an external force is applied to the flow path substrate 42A, the external force is often applied through the ink supply member 43 in contact with an external surface of the flow path substrate 42A. Within the first inner surface 341, therefore, the force most strongly concentrates on a rear-side portion positioned on the rear side of a portion with which the ink supply member 43 is in contact with, the portion being part of the outer surface, so the rear-side portion is most likely to be damaged. However, since the reinforcing projections 36A are placed between the rear-side portion and the second inner surface 342, the flow path substrate 42A is efficiently reinforced.

Furthermore, in this embodiment, discharge of bubbles is not easily impeded. If bubbles are present in the common liquid chamber 34, the amount of ink that can be stored in the common liquid chamber 34 is reduced accordingly, impeding the flow of ink. Therefore, it is desirable to smoothly discharge bubbles in the common liquid chamber 34. Since, in this embodiment, the size of the reinforcing projection 36A is a required minimum, a case in which bubbles come into contact with the reinforcing projections 36A and discharge of these bubbles is thereby impeded is less likely to occur. The bubbles are smoothly discharged from the outflow holes 344 together with ink flows.

Another advantage of the required minimum size of the reinforcing projection 36A is that resistance caused by a contact of ink with the reinforcing projections 36A is minimized. Ink is smoothly supplied to the plurality of pressure chambers 35 without ink flows among the plurality of outflow holes 344 being impeded by the reinforcing projections 36A. The head unit 3A can smoothly jet a necessary amount of ink from each nozzle 33.

Third Embodiment

Figure 7:
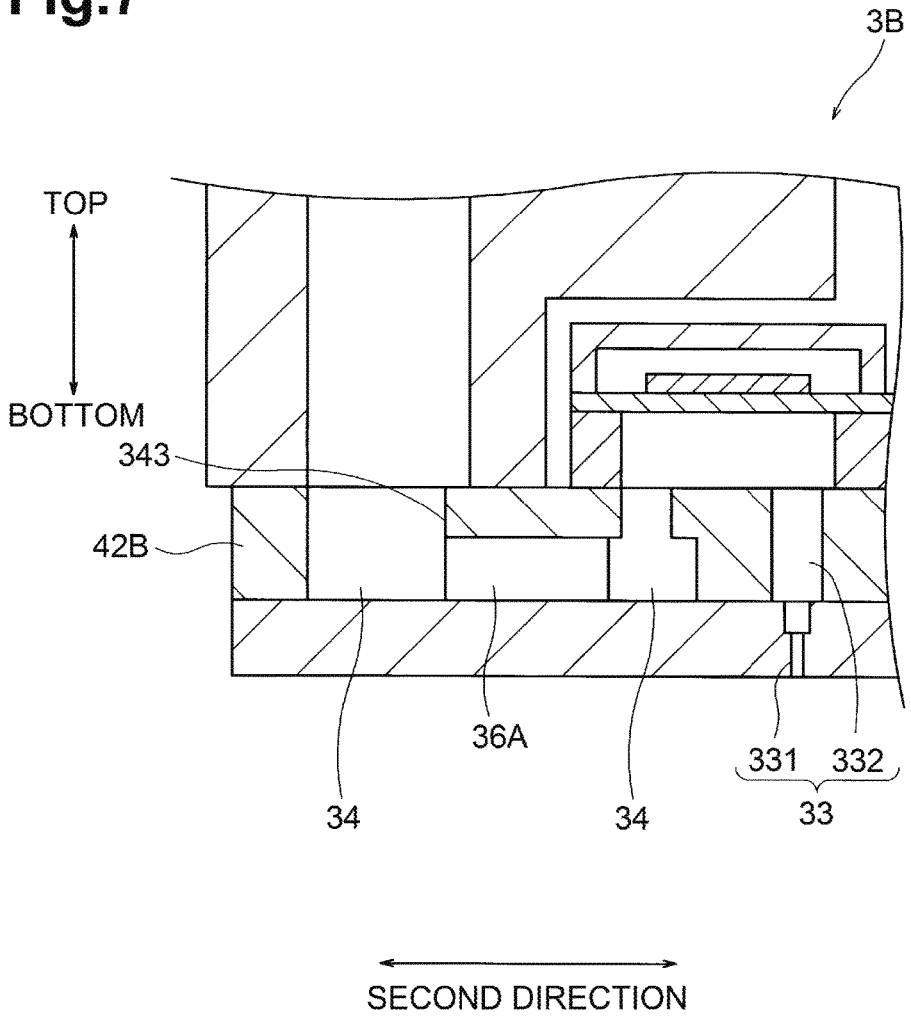
FIG. 7 is an enlarged schematic cross-sectional view illustrating part of the interior of a head unit according to a third embodiment.
Figure 8:
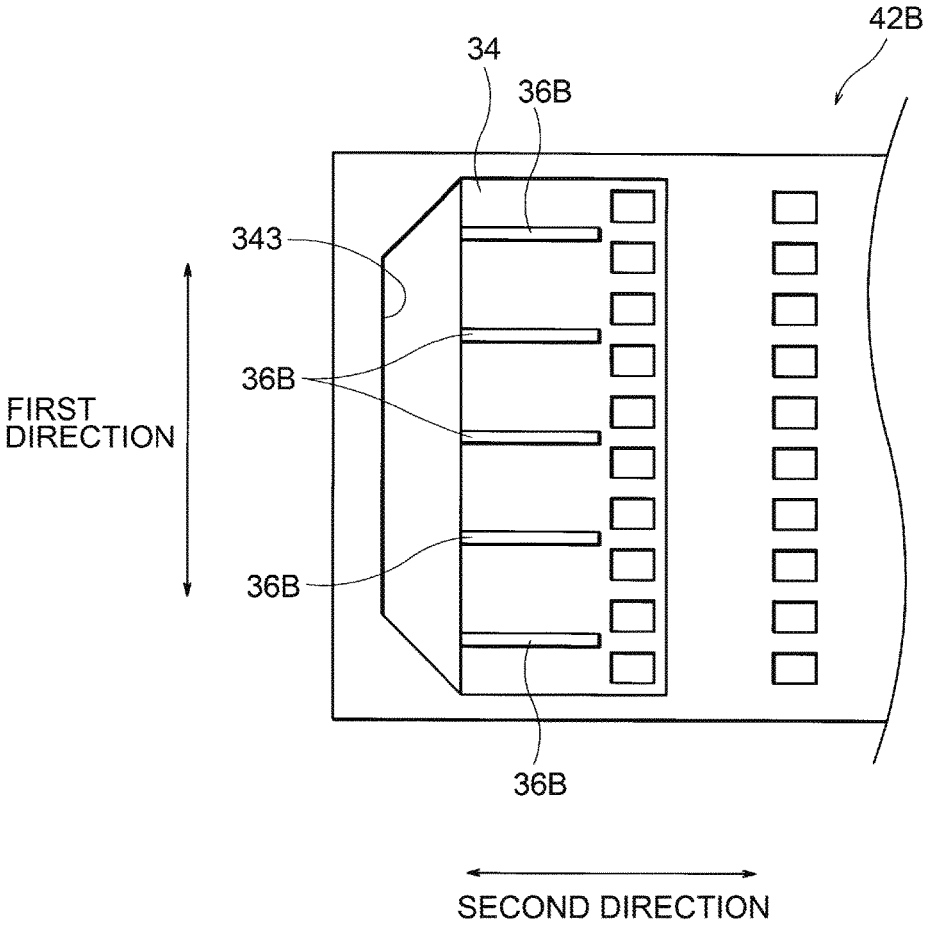
FIG. 8 is a schematic bottom view illustrating the bottom surface of a flow path substrate according to the third embodiment.

In a head unit 3B according to a third embodiment as illustrated, for example, in FIG. 7 and FIG. 8, a plurality of reinforcing projections 36B are provided in a flow path substrate 42B so as to extend to an edge of the supply hole 343. The structures of other parts of the head unit 3B are the same as in the first embodiment.

Since, in this embodiment, the reinforcing projection 36B is provided so as to extend to an edge of the supply hole 343, ink that has been supplied through the supply hole 343 immediately flows among the plurality of reinforcing projections 36B. The flow rate of the ink is increased by the reinforcing projections 36B extending to the edge of the supply hole 343. Therefore, even if bubbles are included in the ink, after the bubbles have passed through the supply hole 343, it is difficult for the bubbles to stay in the common liquid chamber 34 at portions upstream of the reinforcing projections 36B, so the bubbles are smoothly discharged together with ink flows. Therefore, the head unit 3B can smoothly jet a necessary amount of ink from each nozzle 33, without ink flows being impeded by bubbles.

Fourth Embodiment

Figure 9:
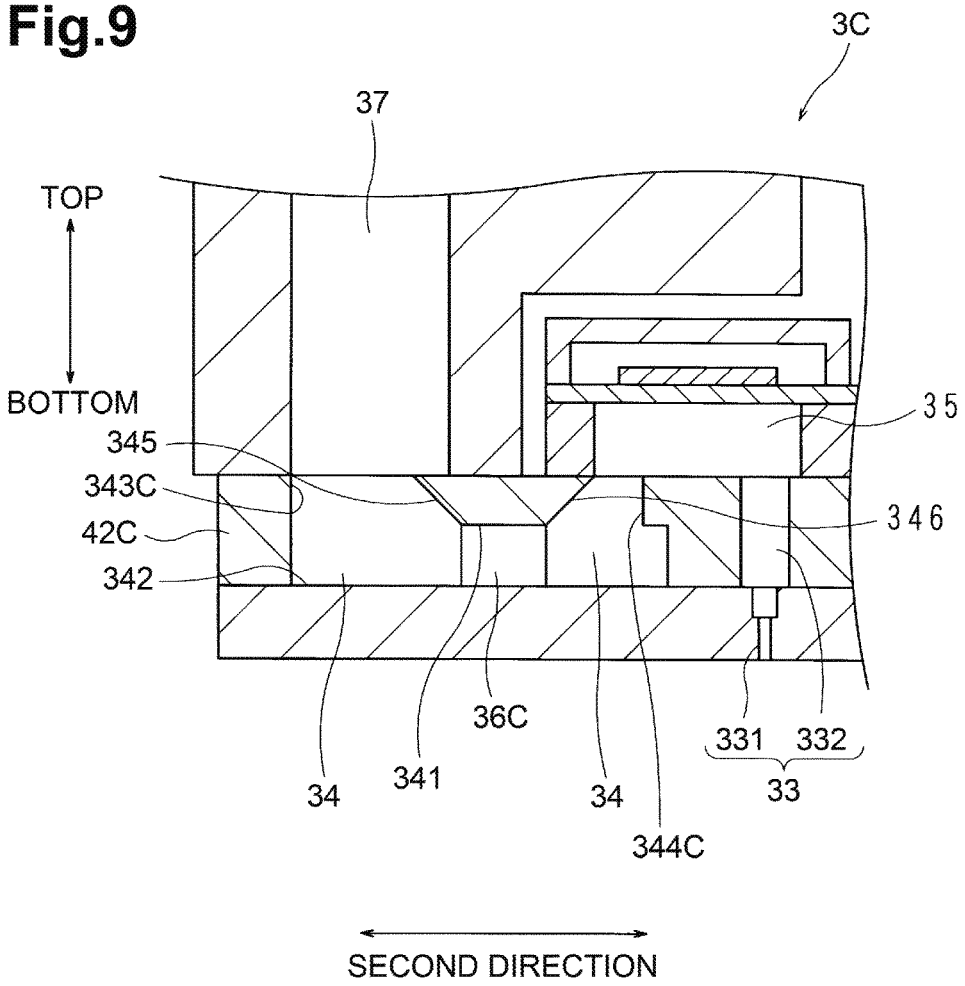
FIG. 9 is an enlarged schematic cross-sectional view illustrating part of the interior of a head unit according to a fourth embodiment.

In a head unit 3C according to a fourth embodiment as illustrated, for example, in FIG. 9, an inclined part 345 is formed as part of the inner walls of a supply hole 343C formed in a flow path substrate 42C, the part being closest to an outflow hole 344C. The inclined part 345 is inclined so that the supply hole 343C expands toward the common liquid chamber 34. An inclined part 346 is also formed as part of the inner walls of the outflow hole 344C, the part being closest to the supply hole 343C. The inclined part 346 is inclined so that the outflow hole 344C expands toward the common liquid chamber 34. Reinforcing projections 36C are placed neither between the second inner surface 342 and the inclined part 345 in the supply hole 343C nor between the second inner surface 342 and the inclined part 346 in the outflow hole 344C. The structures of other parts of the head unit 3C are the same as in the first embodiment.

The diameter of the supply hole 343C is increased toward the common liquid chamber 34. Therefore, ink supplied from the reservoir 37 through supply hole 343C to the common liquid chamber 34 smoothly flows. Since the inclined part 345 is inclined so that the diameter of the inclined part 345 is larger at a position closer to the outflow hole 344C, ink smoothly flows toward the outflow hole 344C. The diameter of the outflow hole 344C is increased toward the common liquid chamber 34. Therefore, much ink in the common liquid chamber 34 flows into the outflow hole 344C. Since the inclined part 346 is inclined so that the diameter of the outflow hole 344C is larger at a position closer to the supply hole 343C, ink that has flowed from the supply hole 343C smoothly flows into the outflow hole 344C. Since, as described above, the reinforcing projections 36C are placed neither between the inclined part 345 and the second inner surface 342 nor between the inclined part 346 and the second inner surface 342, the reinforcing projections 36C do not impede smooth ink flows. Therefore, ink is smoothly supplied to the pressure chambers 35, and the head unit 3C can smoothly jet a necessary amount of ink from each nozzle 33.

Fifth Embodiment

Figure 10:
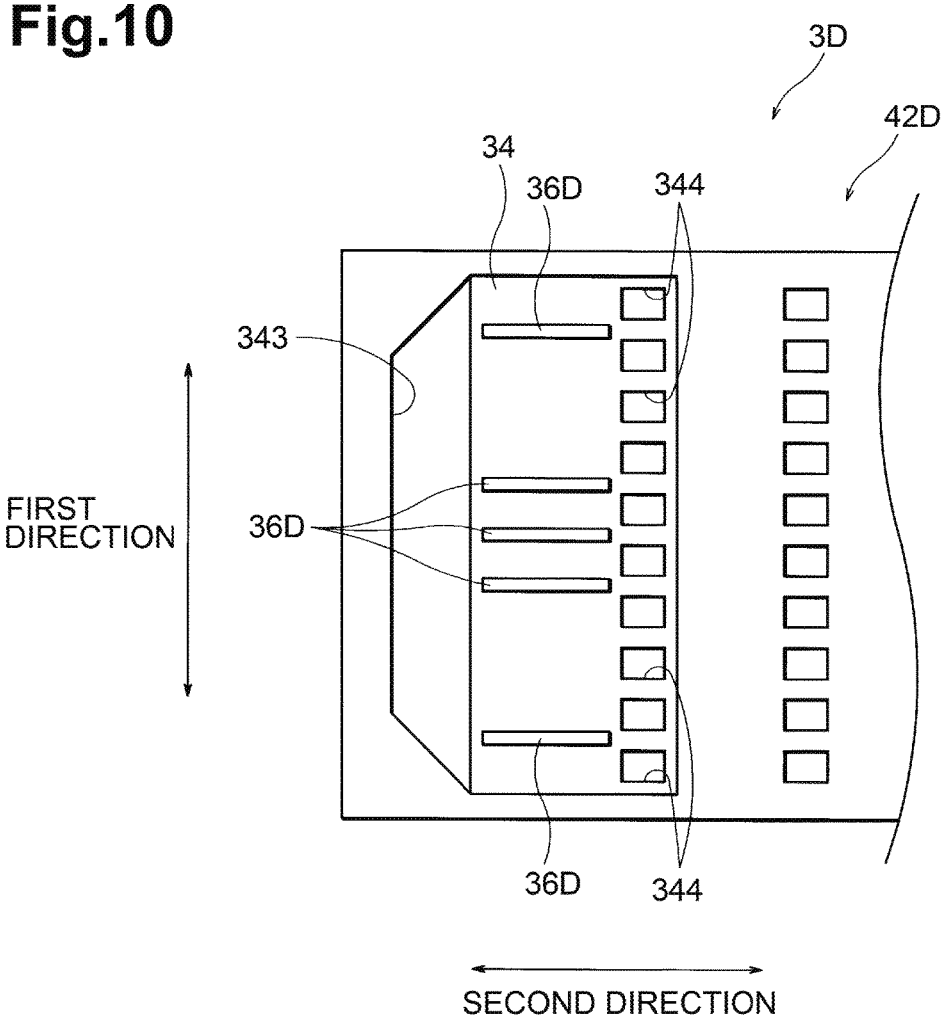
FIG. 10 is a schematic bottom view illustrating the bottom surface of a flow path substrate according to a fifth embodiment.

In a flow path substrate 42D in a head unit 3D according to a fifth embodiment as illustrated, for example, in FIG. 10, a plurality of reinforcing projections 36D are placed at unequal intervals. In a string of a plurality of reinforcing projections 36D arranged along the first direction, the number of reinforcing projections 36D per unit length of the string differs depending on the portion, in the string, in the first direction. Specifically, the number of reinforcing projections 36D per unit length at the center of the string of the reinforcing projections 36D is larger than the number of reinforcing projections 36D per unit length at the ends of the string. Preferably, in the string of the reinforcing projections 36D, the number of the reinforcing projections 36D per unit length is larger at a portion closer to the center of the string. The structures of other parts of the head unit 3D are the same as in any of the first to fourth embodiments.

With the flow path substrate 42D, an external force is most likely to be applied to the center in the first direction. Therefore, the flow path substrate 42D is most likely to be damaged at the center in the first direction and is less likely to be damaged at the ends in the first direction. However, since, in this embodiment, the number of reinforcing projections 36D per unit length of the string of the reinforcing projections 36D is large at the center, the portion at which the flow path substrate 42D is likely to be damaged is efficiently reinforced.

Figure 11:
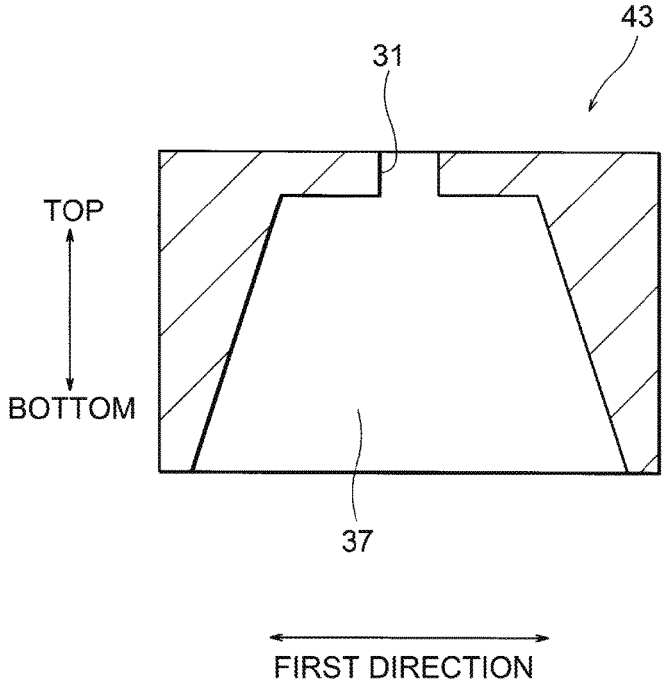
FIG. 11 is a schematic cross-sectional view of an ink supply member.

FIG. 11 is a cross-sectional view of the ink supply member 43 as taken along line XI-XI in FIG. 3. The horizontal direction in FIG. 11 corresponds to the first direction. The introduction hole 31 is located at the center in the first direction. When ink is supplied from the ink tank 13 through the introduction hole 31 to the reservoir 37, the ink flows in the reservoir 37 so as to expand from the center in the first direction toward both ends. Therefore, the amount of ink supplied from the reservoir 37 through the supply hole 343 to the common liquid chamber 34 is large at the center in the first direction, and is small at the ends. The smaller the number of reinforcing projections 36D per unit length of the string of the reinforcing projections 36D is, the more easily ink flows in the common liquid chamber 34. Since, in this embodiment, the number of reinforcing projections 36D per unit length of the string of the reinforcing projections 36D along the first direction is smaller at the ends than at the center, so ink more easily flows at the ends. In addition, since ink easily flows at the ends along the first direction and is harder to flow at the center, ink easily flows from the center in the first direction to the ends.

Although the amount of ink supplied to the common liquid chamber 34 through the supply hole 343 is large at the center in the first direction and is small at the ends, ink still easily flows at the ends and also easily flow from the center toward the ends. Therefore, the amounts of ink that differ depending on the portion along the first direction are more equalized. Since the amounts of ink flowing out of the plurality of outflow holes 344 are thereby equalized, ink is smoothly supplied to all of the plurality of pressure chambers 35. Therefore, the head unit 3D can smoothly jet a necessary amount of ink from each nozzle 33.

Sixth Embodiment

Figure 12:
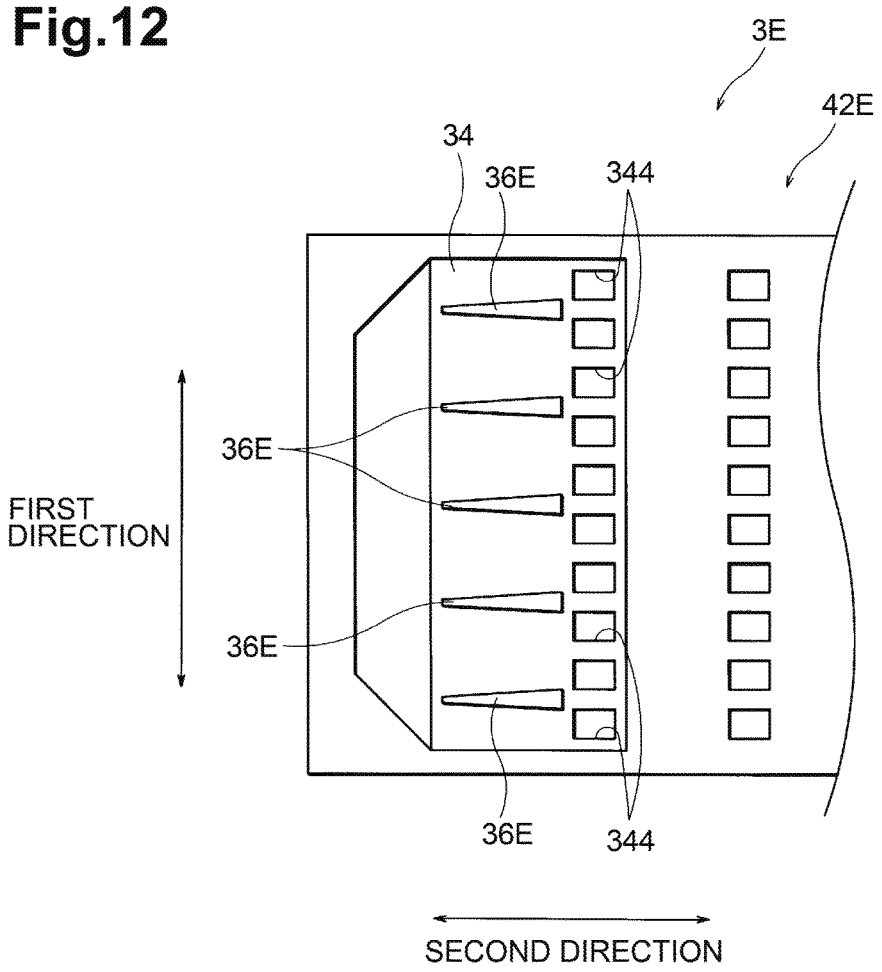
FIG. 12 is a schematic bottom view illustrating the bottom surface of a flow path substrate according to a sixth embodiment.

In a flow path substrate 42E in a head unit 3E according to a sixth embodiment as illustrated, for example, in FIG. 12, the thickness of a reinforcing projection 36E changes depending on the position along the second direction; the closer to the outflow hole 344 the position is, the larger the thickness is. The structures of other parts of the head unit 3E are the same as in any of the first to fifth embodiments.

Since the reinforcing projection 36E is thicker at a position closer to the outflow hole 344, a spacing between each two adjacent reinforcing projections 36E is narrower at a position closer to the relevant outflow holes 344. Therefore, when ink flows between reinforcing projections 36E toward relevant outflow holes 344, the flow rate of ink is made high. At the high flow rate of ink, the ink is quickly supplied to the pressure chambers 35. The high flow rate of ink also enables bubbles included in the ink to be quickly discharged from the common liquid chamber 34. Therefore, the head unit 3E can smoothly jet a necessary amount of ink from each nozzle 33, without ink flows being impeded by bubbles.

Although FIG. 12 illustrates an example in which the thickness of the reinforcing projection 36E linearly changes, the thickness of the reinforcing projection 36E may change in a curved manner. For example, the shape of the reinforcing projection 36E may be elliptical in a plan view.

Seventh Embodiment

Figure 13:
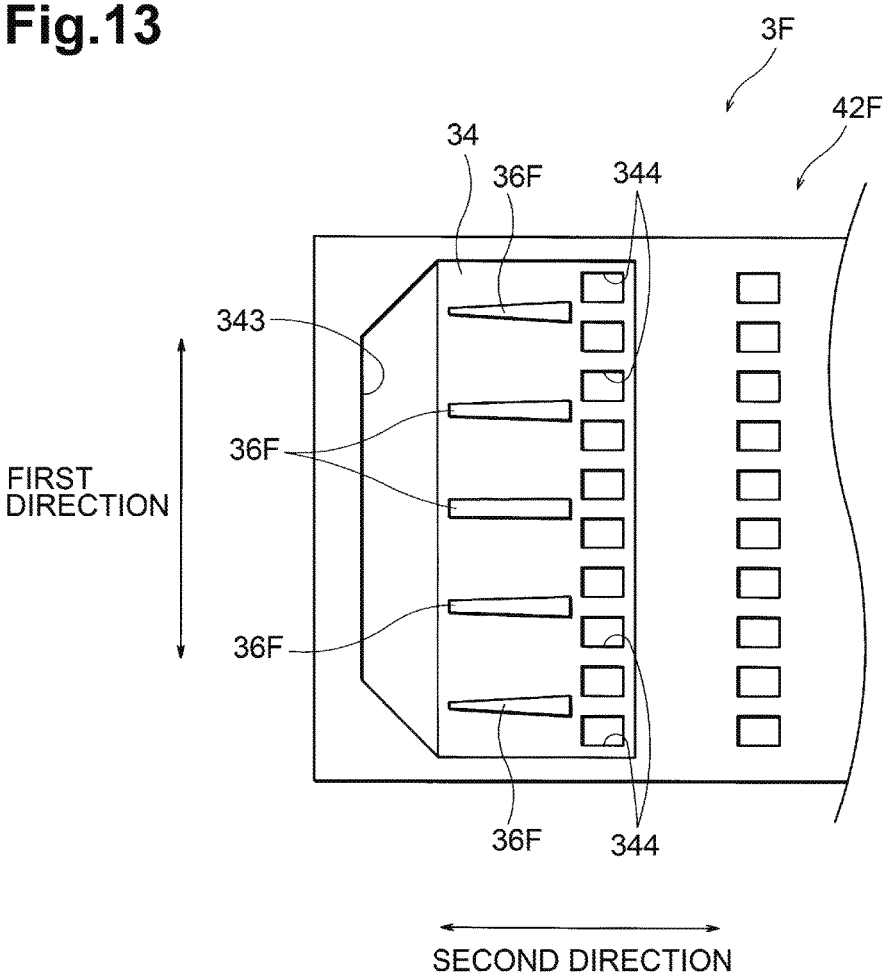
FIG. 13 is a schematic bottom view illustrating the bottom surface of a flow path substrate according to a seventh embodiment.

In a flow path substrate 42F in a head unit 3F according to a seventh embodiment as illustrated, for example, in FIG. 13, the thickness of a reinforcing projection 36F is larger at a position closer to the outflow hole 344, as in the sixth embodiment. In a string of a plurality of reinforcing projections 36F arranged along the first direction, an amount by which the thickness of the reinforcing projection 36F changes depending on the position along the second direction; the amount of change at the reinforcing projection 36F at an end in the string is larger than the amount of change at the reinforcing projection 36F at the center of the string. Preferably, an amount by which the thickness of the reinforcing projection 36F changes depending on the position along the second direction is increased as the position of the reinforcing projection 36F in the string of the reinforcing projections 36F comes closer to an end of the string. The structures of other parts of the head unit 3F are the same as in the sixth embodiment.

In this embodiment, in a string of reinforcing projections 36F, an amount by which the thickness of the reinforcing projection 36F changes is larger at the reinforcing projections 36F at the ends in the string than at the reinforcing projection 36F at the center of the string. Therefore, the flow rate of ink flowing between reinforcing projections 36F toward the relevant outflow holes 344 is increased at the ends of the string of the reinforcing projections 36F. As described in the fifth embodiment, the amount of ink supplied from the reservoir 37 through the supply hole 343 to the common liquid chamber 34 is large at the center in the first direction and is small at the ends. Since the flow rate of ink flowing between reinforcing projections 36F toward the relevant outflow holes 344 is high at the ends of the string of the reinforcing projections 36F, the amounts of ink that differ depending on the portion along the first direction are more equalized. Since the amounts of ink flowing out of the plurality of outflow holes 344 are thereby equalized, ink is smoothly supplied to all of the plurality of pressure chambers 35. Therefore, the head unit 3F can smoothly jet a necessary amount of ink from each nozzle 33.

Eighth Embodiment

Figure 14:
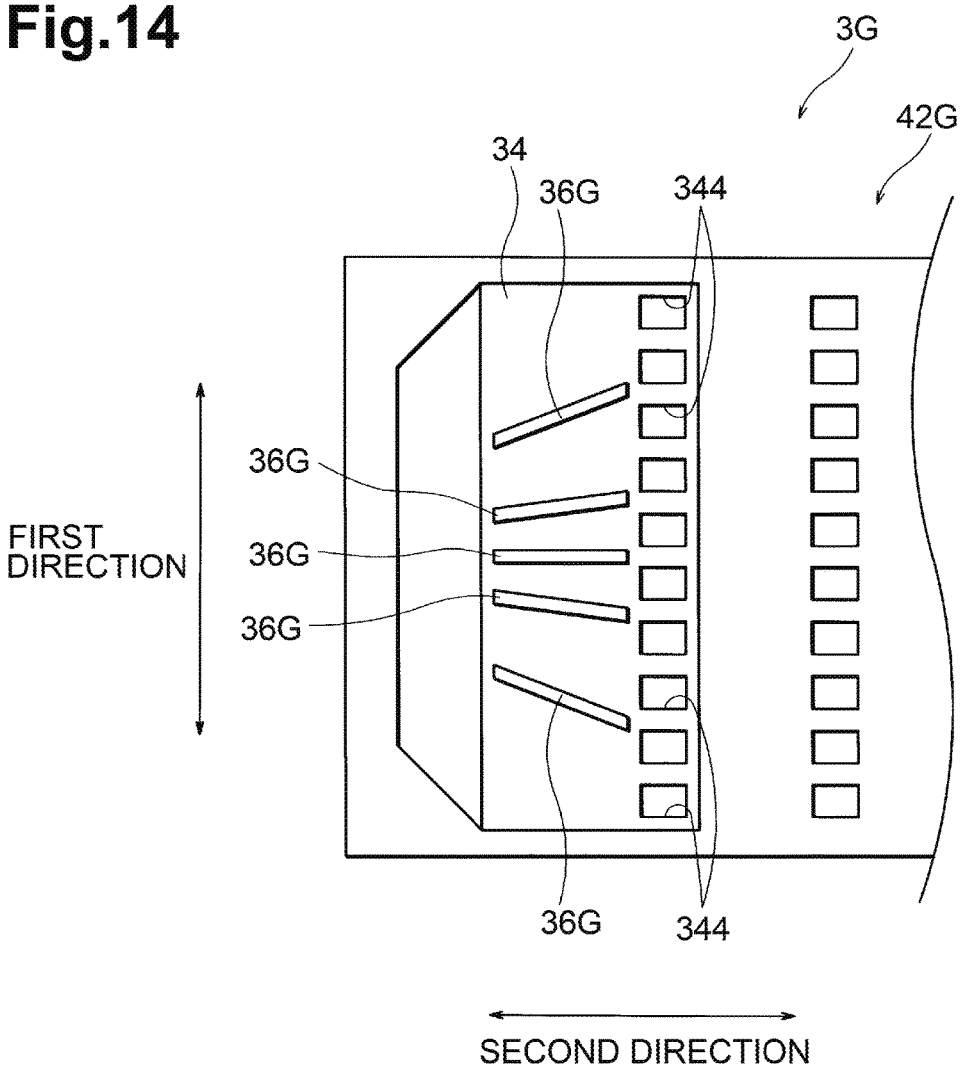
FIG. 14 is a schematic bottom view illustrating the bottom surface of a flow path substrate according to an eighth embodiment.

In a flow path substrate 42G in a head unit 3G according to an eighth embodiment as illustrated, for example, in FIG. 14, a plurality of reinforcing projections 36G are inclined with respect to the first direction through mutually different angles. The distance between each two adjacent reinforcing projections 36G becomes larger at a position closer to the relevant outflow holes 344. Specifically, the plurality of reinforcing projections 36G are substantially radially placed as illustrated in FIG. 14. In the string of the reinforcing projections 36G, the distance between two adjacent reinforcing projections 36G is larger at an end of the string than at the center of the string. Preferably, the distance between two adjacent reinforcing projections 36G becomes larger as they come closer to an end of the string of the reinforcing projections 36G. The structures of other parts of the head unit 3G are the same as in any of the first to seventh embodiments.

The larger the distance between two adjacent reinforcing projections 36G is, the smaller resistance caused by a contact of ink with the reinforcing projections 36G is. Since, in this embodiment, the distance between two adjacent reinforcing projections 36G is larger at a position closer to the relevant outflow holes 344, the resistance becomes smaller at a position closer to the relevant outflow holes 344. Therefore, ink in the common liquid chamber 34 smoothly flows toward the outflow holes 344.

Since, in this embodiment, the distance between two adjacent reinforcing projections 36G positioned at an end is larger than the distance between two adjacent reinforcing projections 36G positioned at the center, resistance caused by a contact of ink with the reinforcing projections 36G is smaller at the end. As described in the fifth embodiment, the amount of ink supplied to the common liquid chamber 34 is large at the center along the first direction and is small at the ends. At each end along the first direction, the amount of ink supplied is small, but resistance caused by a contact of ink with the reinforcing projections 36G is small, so ink more smoothly flows toward the relevant outflow holes 344, when compared with an ink flow at the center. Therefore, the amounts of ink that differ depending on the portion along the first direction are more equalized. Since the amounts of ink flowing out of the plurality of outflow holes 344 are thereby equalized, ink is smoothly supplied to all of the plurality of pressure chambers 35. Therefore, the head unit 3G can smoothly jet a necessary amount of ink from each nozzle 33.

Next, a variation of the above embodiments will be described. The inkjet printer 1 is not limited to a serial printer, in which the recording head 12 is scanned in a direction crossing the feed direction. The inkjet printer 1 may be a line printer that uses a recording head prolonged in a direction crossing the feed direction. The recording sheet 2 fed by the inkjet printer 1 is not limited to recording paper. Any type of recordable medium (such as, for example, a cloth) may be used.

Although, in the examples in the first to eighth embodiments, the number of reinforcing projections 36 and 36A to 36G has been smaller than the number of outflow holes 344, the number of reinforcing projections may be equal to the number of outflow holes 344. That is, one reinforcing projection may be provided for each of a plurality of outflow hole 344. Thus, the flow rates of ink flowing toward the outflow holes 344 are increased, enabling bubbles to be reliably discharged.

The embodiments disclosed this time are only illustrative in all respects and should be considered to be non-restrictive. The scope of the present invention is not restricted to the above description, but is intended to be indicated by the scope of the claims of the present invention and to include meanings equivalent to those in the scope of the claims of the present invention as well as all possible modifications within the scope.

What is claimed is:

1. A liquid jetting device comprising:

a common liquid chamber in fluid communication with a reservoir, the common liquid chamber having a first surface and a second surface opposite to the first surface and including an upstream portion and a downstream portion;

a plurality of outflow holes in the first surface, the plurality of outflow holes being arranged along a first direction;

a plurality of pressure chambers in fluid communication with the plurality of outflow holes; and a plurality of projections disposed between the first surface and the second surface transverse to the first direction and disposed between the upstream portion and the downstream portion, the plurality of the projections defining a plurality of the fluid flow paths therebetween from the upstream portion to the downstream portion, the fluid flow paths rejoining at the downstream portion, the plurality of projections being arranged along the first direction and the plurality of projections contacting both the first surface and the second surface, wherein the outflow holes in the first surface are at the downstream portion of the common liquid chamber and extend between the downstream portion and the pressure chamber through the first surface in a second direction, wherein each of the plurality of projections comprises a first end portion and a second end portion, the second end portion opposed to the first end portion, the first end portion closer to the outflow holes than the second end portion, wherein the second direction extends in a direction parallel with a virtual line extending between the second end portion and the first end portion, and wherein the first direction is orthogonal to the second direction, wherein the plurality of projections are on an opposite side of a plane orthogonal to the second direction and extending through the outflow holes.

2. The liquid jetting device according to claim 1, wherein the number of the plurality of projections is smaller than the number of the plurality of outflow holes.

3. The liquid jetting device according to claim 1, further comprising:

a first member having the first surface formed thereon and a third surface formed on an opposite side of the first member in the second direction; and a second member in contact with the third surface of the first member at a contact area;

wherein the plurality of projections are placed only in an area that overlaps the contact area in the second direction.

4. The liquid jetting device according to claim 1, wherein the first inner surface is formed in the first member by half-etching.

5. The liquid jetting device according to claim 1, wherein the plurality of projections include a first projection;

a second projection; and a third projection, wherein a distance between the first projection and the second projection in the first direction is different from a distance between the second projection and the third projection in the first direction.

6. The liquid jetting device according to claim 5, wherein the first projection is closer to a center of a plurality of projections in the first direction than the second projection, wherein the second projection is closer to the center of a plurality of projections in the first direction than the third projection, and wherein a distance between the first projection and the second projection in the first direction is smaller than a distance between the second projection and the third projection in the first direction.

7. The liquid jetting device according to claim 6, wherein the distance between adjacent projections decreases as the distance from the center of the plurality of projections decreases.

8. The liquid jetting device according to claim 1, further comprising a supply hole extending between the upstream portion and the reservoir through the first surface, wherein at least one of the projections extends along the first surface to an edge of the supply hole in the first surface.

9. The liquid jetting device according to claim 1, further comprising a supply hole extending between the upstream portion and the reservoir through the first surface, wherein the supply hole includes a first wall portion at an incline to the first surface, the first wall portion tapering the supply hole toward the reservoir.

10. The liquid jetting device according to claim 9, wherein at least one of the outflow holes includes a second wall portion at an incline to the first surface, the second wall portion tapering the at least one of the outflow holes towards the pressure chamber.

11. The liquid jetting device according to claim 10, wherein the first wall portion extends from the first surface at a first end and the second wall portion extends from the first surface at a second end, the plurality of projections disposed between a first plane extending through the first end parallel to the second direction and parallel to the first direction and a second plane extending through the second end parallel to the first plane.

12. The liquid jetting device according to claim 1, wherein a thickness of each projection in the first direction changes depending on a relative position between the first end portion and the second end portion.

13. The liquid jetting device according to claim 12, wherein the plurality of projections include:

a first projection; and a second projection farther from a center of the plurality of projections in the first direction than the first projection, wherein an amount by which a thickness of the second projection changes depending on a relative position between the first end portion and the second end portion of the second projection is larger than an amount by which a thickness of the first projection changes depending on a relative position between the first end portion and the second end portion of the first projection.

14. The liquid jetting device according to claim 13, wherein an amount by which the thickness of each projection changes depending on a relative position between the first end portion and the second end portion decreases as a distance of the projection from a center of plurality of projections decreases.

15. The liquid jetting device according to claim 1, wherein at least one of the projections is disposed at an angle relative to at least another of the projections.

16. The liquid jetting device according to claim 15, wherein the plurality of projections include:

a first projection; and a second projection farther from a center of the plurality of projections in the first direction than the first projection; and a third projection farther from the center of the plurality of projections in the first direction than the second projection, wherein an angle between the first projection and the second projection is smaller than an angle between the first projection and the third projection.

17. The liquid jetting device according to claim 16, wherein the angle between adjacent projections decreases as the distance from a center of the plurality of projections decreases.

18. The liquid jetting device according to claim 1, wherein the first surface and the second surface are parallel.

19. The liquid jetting device according to claim 1, wherein the plurality of projections extend from the first surface to the second surface in the second direction.

20. The liquid jetting device according to claim 1, further comprising:

a first member forming the first surface; and a second member forming at least a surface of the pressure chamber, wherein the second member is in contact with the first member.

21. The liquid jetting device according to claim 1, wherein, during operation of the liquid jetting device, the second direction is the direction of the earth's gravitational force at a location of the liquid jetting device.

22. A liquid jetting device comprising:

a common liquid chamber in fluid communication with a reservoir, the common liquid chamber having a first surface and a second surface opposite to the first surface;

a plurality of outflow holes in the first surface of the common liquid chamber and arranged along a first direction;

a plurality of pressure chambers in fluid communication with the plurality of outflow holes, the plurality of outflow holes extending between the common liquid chamber and the pressure chamber through the first surface in a second direction, a plurality of projections disposed between the first surface and the second surface transverse to the first direction and arranged along the first direction; and a first member having the first surface formed thereon and a third surface formed on an opposite side of the first member in the second direction, and the plurality of projections contacting both the first surface and the second surface, and wherein the outflow holes in the first surface are at a downstream portion of the common liquid chamber as compared to the plurality of projections, wherein each of the plurality of projections comprises a first end portion and a second end portion, the second end portion opposed to the first end portion, the first end portion closer to the outflow holes than the second end portion, wherein the second direction extends in a direction parallel with a virtual line extending between the second end portion and the first end portion, and wherein the first direction is orthogonal to the second direction; and a second member forming a surface of the reservoir, the second member in contact with the third surface of the first member at a contact area;

wherein the plurality of projections are placed only in an area that overlaps the contact area in the second direction.

23. A liquid jetting device comprising:

a common liquid chamber in fluid communication with a reservoir, the common liquid chamber having a first surface and a second surface opposite to the first surface;

a plurality of outflow holes in the first surface of the common liquid chamber and arranged along a first direction;

a plurality of pressure chambers in fluid communication with the plurality of outflow holes; and a plurality of projections disposed between the first surface and the second surface transverse to the first direction and arranged along the first direction, and the plurality of projections contacting both the first surface and the second surface, and wherein the outflow holes in the first surface are at a downstream portion of the common liquid chamber as compared to the plurality of projections, wherein each projection includes a first end portion and a second end portion downstream of the first end portion, the first end portion closer to the outflow holes than the second end portion, wherein the second direction extends in a direction parallel with a virtual line extending between the second end portion and the first end portion, and wherein the first direction is orthogonal to the second direction, wherein a thickness of each projection in the first direction changes depending on a relative position between the first end portion and the second end portion.

* * * * *